US009890640B2

(12) United States Patent
Vetters et al.

(10) Patent No.: US 9,890,640 B2
(45) Date of Patent: Feb. 13, 2018

(54) GAS TURBINE ENGINE TIP CLEARANCE CONTROL

(71) Applicants: Rolls-Royce North American Technologies, Inc., Indianapolis, IN (US); Rolls-Royce Corporation, Indianapolis, IN (US)

(72) Inventors: Daniel Kent Vetters, Indianapolis, IN (US); Michael Abraham Karam, Plainfield, IN (US)

(73) Assignees: ROLLS-ROYCE NORTH AMERICAN TECHNOLOGIES INC., Indianapolis, IN (US); ROLLS-ROYCE CORPORATION, Indianapolis, IN (US)

( * ) Notice: Subject to any disclaimer, the term of this patent is extended or adjusted under 35 U.S.C. 154(b) by 528 days.

(21) Appl. No.: 14/319,897

(22) Filed: Jun. 30, 2014

(65) Prior Publication Data

US 2014/0314568 A1 Oct. 23, 2014

Related U.S. Application Data

(63) Continuation of application No. PCT/US2012/072143, filed on Dec. 28, 2012.

(60) Provisional application No. 61/581,811, filed on Dec. 30, 2011.

(51) Int. Cl.

| | |
|---|---|
| ***F04D 27/02*** | (2006.01) |
| ***F01D 5/14*** | (2006.01) |
| ***F01D 11/24*** | (2006.01) |

(52) U.S. Cl.

CPC ..... *F01D 5/14* (2013.01); *F01D 11/24* (2013.01)

(58) Field of Classification Search

CPC ..... F01D 11/18; F01D 11/24; F01D 11/20; F01D 11/14; F01D 25/08; F05D 2240/15; F05D 2260/231

USPC ..... 415/1, 173.1

See application file for complete search history.

(56) References Cited

U.S. PATENT DOCUMENTS

| | | | |
|---|---|---|---|
| 4,247,247 | A | 1/1981 | Thebert |
| 4,487,016 | A | 12/1984 | Schwarz et al. |
| 5,436,467 | A | 7/1995 | Elsner et al. |
| 5,545,007 | A | 8/1996 | Martin |
| 5,550,387 | A | 8/1996 | Elsner et al. |

(Continued)

FOREIGN PATENT DOCUMENTS

| | | |
|---|---|---|
| FR | 2943717 | 10/2010 |
| JP | 2001342848 | 12/2001 |
| JP | 2008157340 | 7/2008 |

OTHER PUBLICATIONS

International Search Report and Written Opinion, PCT/US2012/072143, dated Aug. 30, 2013.

(Continued)

*Primary Examiner* — Craig Kim
*Assistant Examiner* — Jason Mikus
(74) *Attorney, Agent, or Firm* — McCracken & Gillen LLC

(57) ABSTRACT

A gas turbine engine is disclosed having a thermoelectric device capable of changing a tip clearance in a turbomachinery component. In one non-limiting form the turbomachinery component is a compressor. The thermoelectric device can be used in some forms to harvest power derived from a waste heat. The tip clearance control system can include a sensor used to determine a clearance between a tip and a wall of the turbomachinery component.

18 Claims, 4 Drawing Sheets

(56) References Cited

U.S. PATENT DOCUMENTS

| | | | | |
|---|---|---|---|---|
| 5,605,437 | A | 2/1997 | Meylan | |
| 5,667,358 | A | 9/1997 | Gaul | |
| 6,519,947 | B1 | 2/2003 | Bass et al. | |
| 6,619,019 | B2 | 9/2003 | Bates | |
| 7,013,718 | B2 | 3/2006 | Ingistov et al. | |
| 2004/0045594 | A1* | 3/2004 | Hightower | F02C 6/18 136/205 |
| 2005/0022855 | A1 | 2/2005 | Raver | |
| 2007/0045044 | A1 | 3/2007 | Sullivan | |
| 2008/0135082 | A1* | 6/2008 | Hirono | H01L 35/08 136/239 |
| 2008/0193278 | A1 | 8/2008 | Erickson et al. | |

OTHER PUBLICATIONS

English language translation of FR2943717, Behaghel et al., Oct. 1, 2010.
English language translation of JP 2008-157340, Komatsubara, Jul. 10, 2008.
English language abstract of JP 2001-342848, Toyota Motor Corporation, Dec. 14, 2001.

* cited by examiner

GAS TURBINE ENGINE TIP CLEARANCE CONTROL

CROSS-REFERENCE TO RELATED APPLICATIONS

The present application is a continuation of PCT Application No. PCT/US2012/072143, filed Dec. 28, 2012, which claims the benefit of U.S. Provisional Patent Application 61/581,811, filed Dec. 30, 2011, each of which is incorporated herein by reference.

GOVERNMENT RIGHTS

The present application was made with the United States government support under Contract No. NNH08ZEA001N, awarded by the National Aeronautics and Space Administration. The United States government has certain rights in the present application.

TECHNICAL FIELD

The present invention generally relates to gas turbine engine thermal devices, and more particularly, but not exclusively, to tip clearance control of the gas turbine engine.

BACKGROUND

Providing tip clearance in gas turbine engines remains an area of interest. Some existing systems have various shortcomings relative to certain applications. Accordingly, there remains a need for further contributions in this area of technology.

SUMMARY

One embodiment of the present invention is a unique tip clearance control system. Other embodiments include apparatuses, systems, devices, hardware, methods, and combinations for controlling tip clearance. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
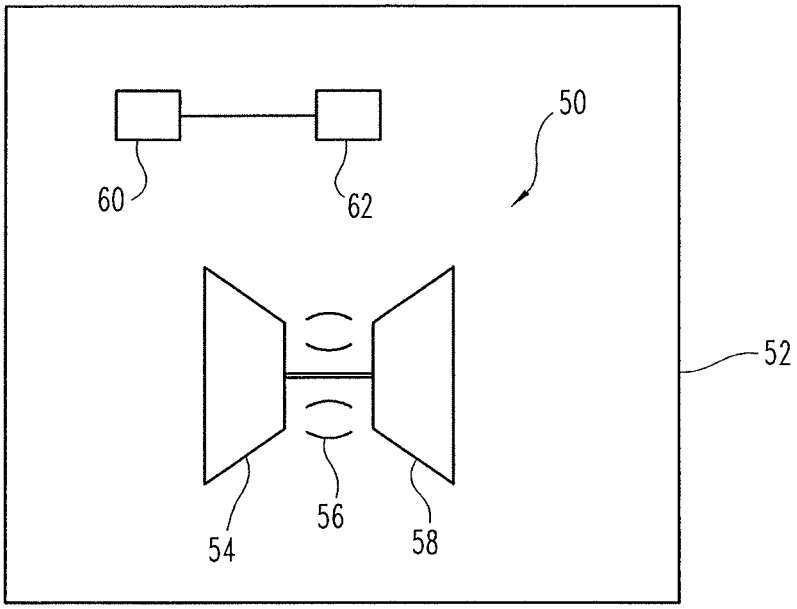
FIG. 1 depicts an embodiment of a gas turbine engine having a tip clearance control system.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, a gas turbine engine 50 is shown having a number of turbomachinery components useful in the generation of power, such as but not limited to providing power for an aircraft 52. As used herein, the term "aircraft" includes, but is not limited to, helicopters, airplanes, unmanned space vehicles, fixed wing vehicles, variable wing vehicles, rotary wing vehicles, unmanned combat aerial vehicles, tailless aircraft, hover crafts, and other airborne and/or extraterrestrial (spacecraft) vehicles. Further, the present inventions are contemplated for utilization in other applications that may not be coupled with an aircraft such as, for example, industrial applications, power generation, pumping sets, naval propulsion, weapon systems, security systems, perimeter defense/security systems, and the like known to one of ordinary skill in the art.

The gas turbine engine 50 includes a compressor 54, combustor 56, and turbine 58 which together operate to produce the power. Air or other suitable working fluid enters to the compressor 54 whereupon it is compressed and routed to the combustor 56 to be mixed with a fuel. The combustor 56 is capable of combusting the mixture of fuel and working fluid. The turbine 58 extracts work from the products of combustion that result from the combustion of fuel and working fluid. In some forms the flow stream exiting the turbine can be routed to a nozzle to produce thrust.

The gas turbine engine 50 can take a variety of forms other than that depicted in the illustrated embodiment. For example, though the embodiment is shown as a single spool engine, other embodiments can include greater numbers of spools. The gas turbine engine 50, furthermore, can take the form of a turbojet, turboprop, turboshaft, or turbofan engine and can be a variable cycle and/or adaptive cycle engine. The gas turbine engine 50 is also depicted in the illustrated embodiment as an axial flow engine, but in other embodiments it can be a radial flow engine and/or a mixed radial/axial flow engine. In short, any variety of forms are contemplated for the gas turbine engine 50.

The gas turbine engine 50 can be coupled with a tip clearance control system 60 which can be use to control a clearance between a tip of an airflow member, such as a moving blade in a turbomachinery component like the compressor 54, and a wall that forms a flow path through the turbomachinery component that is in proximity to the tip of the airflow member. The discussion that follows will often refer to a blade of the turbomachinery component which is but one embodiment of the present application. Therefore, no limitation is hereby intended as to the type of air flow member that the tip clearance control system 60 can be used with. For example, the tip clearance control system could also be used with a vane of the gas turbine engine 50, such as but not limited to a variable vane. Thus, unless stated to the contrary, the term blade and vane can be used interchangeably to identify an air flow member disposed within the turbomachinery component. In one form the tip clearance control system 60 can be used to regulate a temperature of the wall thus changing the thermal growth of the wall to affect a clearance between the airflow member and the wall. The tip clearance control system 60 can be active during all or portions of operation of the gas turbine engine and in one form is capable of anticipating transient events to avoid and/or mitigate a clearance or contact between the blade and the wall.

The controller 60 can be comprised of digital circuitry, analog circuitry, or a hybrid combination of both of these types. Also, the controller 60 can be programmable, an integrated state machine, or a hybrid combination thereof. The controller 60 can include one or more Arithmetic Logic Units (ALUs), Central Processing Units (CPUs), memories, limiters, conditioners, filters, format converters, or the like which are not shown to preserve clarity. In one form, the controller 60 is of a programmable variety that executes algorithms and processes data in accordance with operating logic that is defined by programming instructions (such as software or firmware). Alternatively or additionally, operating logic for the controller 60 can be at least partially defined by hardwired logic or other hardware. In one particular form, the controller 60 is configured to operate as a Full Authority Digital Engine Control (FADEC); however, in other embodiments it may be organized/configured in a different manner as would occur to those skilled in the art. It should be appreciated that controller 60 can be exclusively dedicated to tip clearance control, or may further be used in the regulation/control/activation of one or more other subsystems or aspects of aircraft 52.

The aircraft 52 and/or gas turbine engine 50 can be capable of operating at a variety of conditions in which the tip clearance control system 60 may be exercised. In the illustrated embodiment a sensor 62 is included that can be used to measure/estimate/assess/etc a number of conditions/states/etc. In one form the sensor 62 can be used to measure aircraft flight condition such as speed and altitude, to set forth just two non-limiting examples. The sensor 62 can output any variety of data whether sensed or calculated. For example, the sensor 62 can sense and output conditions such as static temperature, static pressure, total temperature, and/or total pressure, among possible others. In addition, the sensor 62 can output calculated values such as, but not limited to, equivalent airspeed, altitude, and Mach number. Any number of other sensed conditions or calculated values can also be output.

The sensor 62 can also take the form of a proximity sensor useful in providing information regarding a tip clearance between a blade of the turbomachinery component and an adjacent wall. Such information is used by the controller 60 in the regulation of the tip clearance between a moving blade and a wall of the turbomachinery component. In one form the sensor 62 provides real time signals of the distance such that a plurality of distance values as a function time are generated. The sensor 62 can either provide raw sensed information, either analog or digital, or it can provide a computed value. Furthermore, the sensor 62 can output information in a variety of formats and can further be conditioned using additional electronics and/or software. In some forms the sensor 62 can provide multiple useful signals to the controller 60 such as a minimum distance, maximum distance, time varying distance, historical information, etc. Alternatively and/or additionally such information can be computed in the controller 60 or other alternative and/or additional module. No matter the form, content, etc, the sensor 62 is capable of providing sufficient information that enables the controller 60 to regulate the temperature of the wall such that a clearance between the wall and the blade(s) is regulated.

The proximity sensor 62 can be a capacitive sensor or optical sensor, among potential others useful for detecting a tip clearance. The sensor 62 can be configured to withstand elevated temperatures of a gas turbine engine 50, whether in rotating compressor equipment or turbine components, and can be resistant chemical attack as well as resistant to deposition of solids onto its exposed surfaces. Further, the sensor 62 can also be resistant to electromagnetic interference, vibration, noise, and shock, among any number of other characteristics.

Figure 2:
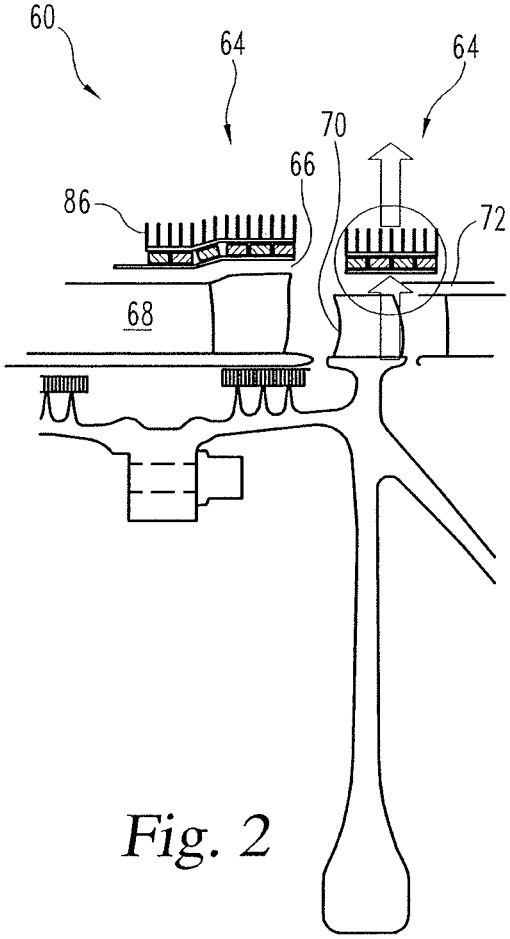
FIG. 2 depicts an embodiment of a tip clearance control system.
Figure 3:
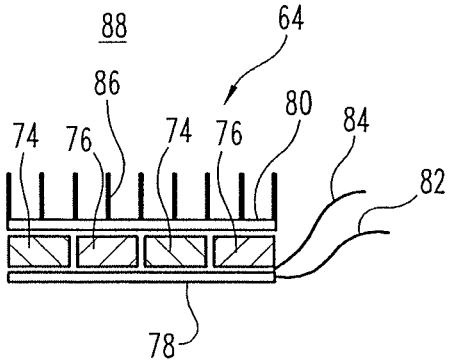
FIG. 3 depicts an embodiment of a tip clearance control system.

Turning now to FIGS. 2 and 3, one form of the tip clearance control system 60 is depicted which is coupled to a thermoelectric device 64 for changing a temperature of a portion 66 of a turbomachinery component. The thermoelectric device 64 can be powered by the engine 50 or a vehicle power system such as may be coupled with an airframe of an aircraft. The temperature of the component can determine its relative size/orientation such that in one form at higher temperatures the component is relatively larger than at low temperatures. The component can be heated by the thermoelectric device to provide a larger size component and cooled to provide a relatively smaller sized component. In this way the thermoelectric device can be a fully reversible system that can either heat or cool the component. Of course, in some embodiments the thermoelectric system can include or be supplemented with circuitry, software logic, electrical components, etc. that provide either a heating or a cooling, but not both. It will be understood that such a system will still include at its core a thermoelectric device that can be operated in both directions were it not for the additional or supplemental configuration. When coupled with changing size/orientation of the blade and/or rotor, the tip clearance control system can selectively heat and cool the component to affect a tip clearance between the component and the blade.

The particular type of thermoelectric device shown in FIGS. 2 and 3 includes a configuration of alternating semiconductor materials, and specifically alternating p-type and n-type semiconductors. The type of device depicted in these figures can also be used in any of the embodiments herein. Any variety of material types can be used to form the thermoelectric device. The thermoelectric devices described herein can take the form of a thermoelastic film which can have any variety of shapes and sizes. Any variety of thermoelectric effects, and accompanying configurations, can be employed by the thermoelectric device to alter a temperature of the turbomachinery component to change a tip clearance between the wall 66 and the blade 70. To set forth just a few examples, thermoelectric devices that rely the Seebeck effect, Peltier effect, and Thomson effect, are all contemplated within the scope of the application.

Thermoelectric heaters/coolers can be coupled with the controller 60 in a way that an electric state of the thermoelectric device 64 can be regulated to control a tip clearance. The thermoelectric device 64 of the illustrated embodiments include a radially inner substrate 78 and a radially outer substrate 80 to which the p-type semiconductor 74 and n-type 76 are coupled. The radially inner substrate 78 is coupled with electrical leads 82 and 84 between which can be a potential difference. The leads 82 and 84 are coupled to the substrate 78 in a way that creates a pathway for current flow through the thermoelectric device 64. In one form the potential difference between the leads 82 and 84 can be the result of a waste heat being captured by the thermoelectric device and in others a potential difference can be applied across the leads to encourage a heat transfer in a certain direction, such as whether to cool or heat the wall 66, to set forth just two non-limiting examples. In still other examples the potential difference applied across the leads can be the result of electric power provided by a thermoelectric device disposed elsewhere whether associated with the vehicle and/or gas turbine engine. In some forms the electric power can originate from a battery that is charged using a thermoelectric device disposed elsewhere. In one non-limiting example, a waste heat can be captured by one thermoelectric device and the electric power stored using a storage device such as but not limited to a battery. Alternatively and/or additionally the waste heat can be used to directly regulate power across another thermoelectric device. In still other forms a waste heat can be stored for purposes other than strictly tip clearance.

Though a number of p-type 74 and n-type 76 are depicted in the illustrated embodiment, more or fewer can also be used. The semiconductors are alternated along the flow stream direction in a pattern that alternates between the types of semiconductors, but any other pattern is also contemplated. In some cases, individual pairings of p-type 74 and n-type 76 semiconductors can be combined with other individual pairings in any number of combinations to be used in the thermoelectric device 64.

The thermoelectric device 64 can extend over the entire periphery of the engine case in some embodiments, while in other embodiments the device 64 may only extend over part of the engine case. In some forms a number of thermoelectric devices 64 can be located about the engine case at the same or different axial stations. In still other alternative and/or additional embodiments, the thermoelectric devices 64 can be configured such that portions of the device distributed around the engine case can be selectively operated. For example, a portion in one circumferential region can be activated to provide one level of heat transfer, while a portion in another circumferential region can be activated to provide another level of heat transfer, whether the heat transfer is a heating or a cooling. Various modules can also be used, which in whole or in part can be operated similarly to provide localized heat transfer to the engine case, again whether that heat transfer is a heating or cooling.

Thermal transfer member 86, which in the illustrate embodiment is in the form of fins but other embodiments need not include fins, can be used to assist in transferring heat between a medium 88 and the wall 66. For example, the medium can be a flowing working fluid, such as a cooling air, to aid in heat transfer when the thermoelectric device 64 is in operation. The thermal transfer fins 86 of the illustrated embodiment can take a variety of shapes and sizes whether generally referred to as a "fin" or other device useful in transferring heat with the medium 88. The thermal transfer fins 86 can cover the entirety of the thermoelectric device 64 or only a portion thereof.

Figure 4:
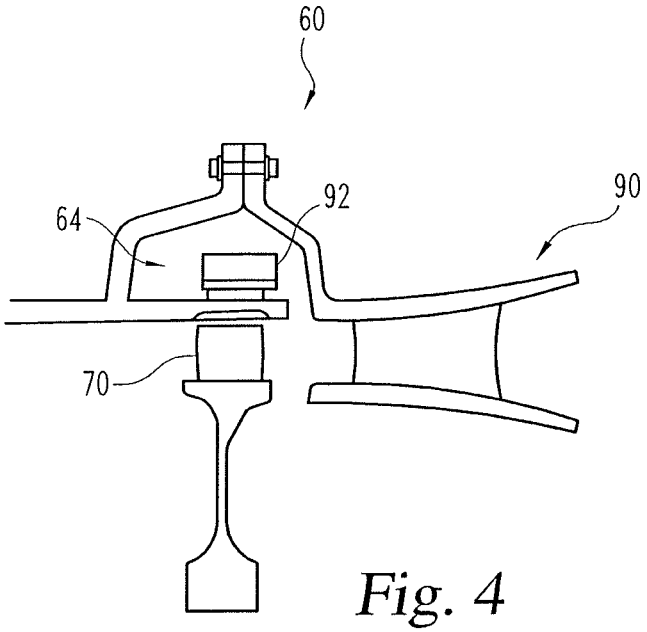
FIG. 4 depicts another embodiment of a tip clearance control system.
Figure 5:
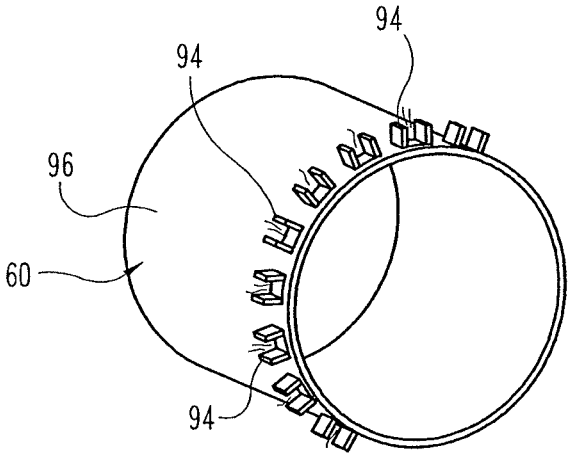
FIG. 5 depicts an embodiment of a tip clearance control system.

Turning now to FIG. 4, another embodiment of the tip clearance control system 60 is shown. The thermoelectric device 64 is shown located above a compressor blade 70 just upstream of a diffuser 90. The thermoelectric device 64 can include a thermal mass 92 that assists in the transfer of heat between the thermoelectric device 64 and a medium in contact with the thermal mass 92. The thermal mass can take a variety of forms such as a cold plate and/or fins. In any of the embodiments herein, any of the fins, cold plates, FIG. 5 shows a view of an embodiment of the tip clearance control system 60 in which a number of thermoelectric devices in the form of modules 94 are spaced about the circumference of a gas turbine engine case 96. The modules 94 are evenly distributed in a single row round the circumference of the case 96, but other arrangements are also contemplated. For example, a higher concentration of modules 94 can be located at certain circumference locations than other. Some modules 94 can be axially offset from others, while in other embodiments additional rows can also be added. The modules 94 can be controlled individually, in clusters, or as a whole. Furthermore, the modules 94 can have different sizes, configurations, capabilities, etc even though the illustrated embodiment depicts similar modules. In sum, any variety of physical and control arrangements as well as size and capabilities are contemplated.

The thermoelectric devices described herein can be affixed to a casing or other suitable gas turbine engine structure through a variety of techniques. In one non-limiting form the thermoelectric devices can be affixed via a thermally conductive bond. The thermoelectric devices can be affixed to the bond at discrete locations around the casing or other suitable structure, or for a full circumferential length around the casing, etc.

The thermoelectric devices described herein can be powered using a variety of power sources. In one non-limiting embodiment the electrical power originates from a generator driven by the gas turbine engine 50. In other additional and/or alternative embodiments the thermoelectric device can be powered by an energy storage device, such as a battery. In still further additional and/or alternative forms the thermoelectric devices can be powered by other thermoelectric devices, some of which can be in thermal communication with the gas turbine engine.

Figure 6:
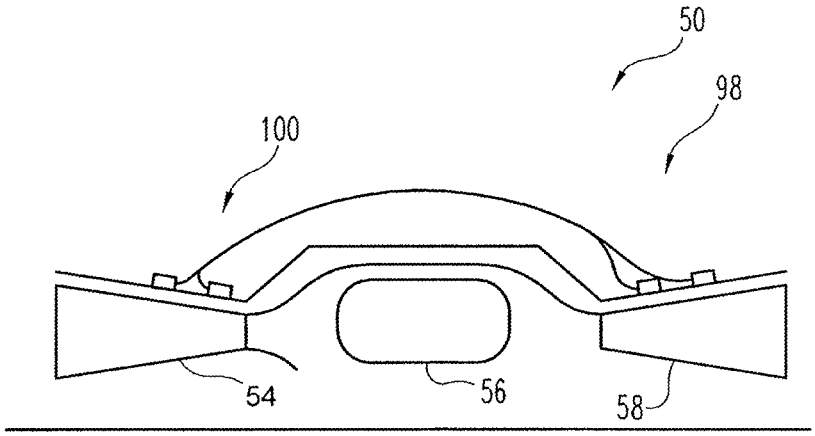
FIG. 6 depicts an arrangement of thermoelectric devices.

FIG. 6 depicts an arrangement of thermoelectric devices used in the gas turbine engine 50 in which one device 98, or a set of devices is used to provide power to another device 100, or set of devices. In the illustrated embodiment two separate rows of thermoelectric devices are shown in each of the compressor 54 and the turbine 58. The devices 98 shown as thermally coupled with the turbine 58 in the illustrated embodiment can be used to generate power to drive the devices 100 shown as thermally coupled with the compressor 54. Though the illustrated embodiment depicts flowing power from devices in a turbine area to devices in a compressor area, other locations and directions of power transfer are contemplated. In this way power generated using a thermoelectric devices in one location of the gas turbine engine can be used to power thermoelectric devices in another location. To set forth another non-limiting example, one embodiment would be to coupe the tip clearance control system with a set of thermoelectric modules attached elsewhere to the engine or to hardware mounted on the engine such as a bleed air duct.

In any of the embodiments described in the application, the tip clearance, or gap, can be set during manufacture of the turbomachinery component and/or gas turbine engine to favor a certain flight condition, engine operating environment, operational demands, etc. For example, the tip clearance can be set to accommodate a snap deceleration in which a tip clearance is typically the tightest owing to a faster cooling of the casing than the rotating disc and blades. In this case the gap can be manipulated during cruise by supplying power to the thermoelectric devices.

Though various of the illustrated embodiments discussed above depicts controlling a tip clearance e of a compressor section of the gas turbine engine, the tip clearance control system 60 could also be used in the turbine section as well. The thermoelectric device is shown as being coupled at a radially outer portion of the flow path 68 but other locations are also contemplated to affect a change in a tip clearance between a blade 70 and wall 66.

One aspect of the present application provides an apparatus comprising a gas turbine engine having a flow path wall disposed around an airfoil shaped component, a thermoelectric tip clearance module disposed in thermal communication with the flow path wall having a thermoelectric core operable to provide one of thermal growth and thermal shrinkage to the flow path wall, and a controller structured to regulate the thermoelectric core of the thermoelectric tip clearance module to change a size of the flow path wall relative to the airfoil shaped component.

A feature of the present application provides wherein the controller is structured to regulate an electrical power to the thermoelectric core, and the thermoelectric tip clearance module is in the form of a film coupled with the gas turbine engine.

Another feature of the present application further includes thermal protrusions extending from the thermoelectric tip clearance module to assist in heat transfer.

Still another feature of the present application provides wherein the thermoelectric tip clearance module includes a plurality of modules arrayed about the gas turbine engine.

Still yet another feature of the present application provides wherein the modules are arrayed in different locations of the gas turbine engine, a first module of the plurality of modules providing power to drive a second module of the plurality of modules.

Yet still another feature of the present application provides wherein the modules are arrayed in different locations of the gas turbine engine, a first module of the plurality of modules providing power to drive a second module of the plurality of modules.

A further feature of the present application provides wherein at least one module of the plurality of modules is located in thermal communication with a turbine of the gas turbine engine, and a second module of the plurality of modules is located in a compressor of the gas turbine engine.

A still further feature of the present application provides wherein the flow path wall is adjacent a cantilevered vane such that the thermoelectric tip clearance module alters a gap formed by the cantilevered vane, and wherein the gas turbine engine is structured to provide a flow path for relatively cool air to assist in heat transfer through the flow path wall to the thermoelectric core.

Another aspect of the present application provides an apparatus comprising a gas turbine engine turbomachinery component having an airfoil shape disposed in proximity to a flow path boundary of the turbomachinery component, a thermally reversible electrical device capable of altering the magnitude and direction of heat transfer to the flow path boundary by a change in current to the thermally reversible electrical device, and a tip clearance control module capable of changing a current used to drive the thermally reversible electrical device.

A feature of the present application provides wherein the thermally reversible electrical device includes a plurality of thermally reversible electrical devices.

Another feature of the present application provides wherein the gas turbine engine turbomachinery component is a compressor and the thermally reversible electrical device in thermal communication with the compressor.

Still another feature of the present application further includes a turbine, and wherein a second thermally reversible electrical device is disposed in thermal communication with the turbine, the second thermally reversible electrical device providing power to the thermally reversible electrical device in thermal communication with the compressor.

Yet still another feature of the present application provides wherein the second thermally reversible electrical device includes a plurality of thermally reversible electrical devices.

Still yet another feature of the present application provides wherein the thermally reversible electrical device is a film type device, and the tip clearance control module is structured to change a tip clearance of a vane disposed in the turbomachinery component.

A further feature of the present application includes fins protruding into a flow path of a gas turbine engine to facilitate heat transfer for the thermally reversible electrical device.

Still another aspect of the present application provides an apparatus comprising a gas turbine engine having a combustor capable of burning a fuel and a turbomachinery component in flow communication with the combustor, means for thermoelectrically regulating a tip clearance in the turbomachinery component of the gas turbine engine.

Yet still another aspect of the present application provides a method comprising fueling a gas turbine engine to produce a combustion that sustains a thermodynamic cycle of the engine, passing a working fluid through a turbomachinery device of the gas turbine engine, the turbomachinery device having an airfoil shaped component including an end portion offset from a flow path surface of the gas turbine engine, manipulating a heat transfer of a thermoelectric device in thermal communication with the turbomachinery device to regulate the offset between the end portion of the airfoil shaped component and the flow path surface.

A feature of the present application provides wherein the manipulating includes altering a heat transfer of a thermoelectric device in thermal communication with a flow path surface of the gas turbine engine using a controller.

Another feature of the present application provides wherein the altering a heat transfer includes providing power to a plurality of thermoelectric devices.

Still another feature of the present application provides wherein the manipulating includes changing a temperature of the flow path surface to regulate the offset between the end portion of the airfoil shaped component and the flow path surface.

Yet still another feature of the present application includes extracting electrical power from a turbine thermoelectric device and conveying the power to a compressor thermoelectric device.

Still yet another feature of the present application provides wherein the extracting includes utilizing a plurality of thermoelectric devices.

A further feature of the present application provides wherein the compressor thermoelectric device includes a plurality of thermoelectric devices.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a gas turbine engine having a flow path wall disposed around an airfoil shaped component;

a battery;

a first thermoelectric device disposed in thermal communication with a first portion of the flow path wall, the first thermoelectric device operable to generate heat and thereby affect a thermal transfer between the first thermoelectric device and the first portion of the flow path wall, wherein the first thermoelectric device is powered by the battery;

a controller adapted to regulate heat generated by the thermoelectric device; and a second thermoelectric device disposed in thermal communication with a second portion of the flow path wall, the second thermoelectric device adapted to convert waste heat into electrical power used to charge the battery;

wherein thermal transfer between the first thermoelectric device and the flow path wall affects a change in size of the first portion of the flow path wall and thereby changes a tip clearance between the flow path wall and the airfoil shaped component.

2. The apparatus of claim 1, wherein the controller is structured to regulate an electrical power to the thermoelectric core of the first thermoelectric device, and the first thermoelectric device is in the form of a film coupled with the gas turbine engine.

3. The apparatus of claim 1, which further includes thermal protrusions extending from the first thermoelectric device to assist in heat transfer.

4. The apparatus of claim 1, wherein the first thermoelectric device is one of a plurality of thermoelectric devices arrayed circumferentially about the gas turbine engine.

5. The apparatus of claim 1, wherein at least one device of the first and second thermoelectric devices is located in thermal communication with a turbine of the gas turbine engine, and a second device of the first and second thermoelectric devices is located in thermal communication with a compressor of the gas turbine engine.

6. The apparatus of claim 1, wherein the flow path wall is adjacent a cantilevered vane such that the first thermoelectric device alters a gap formed by the cantilevered vane, and wherein the gas turbine engine is structured to provide a flow path for air to assist in heat transfer from fins disposed above the thermoelectric core of the first thermoelectric device to a medium surrounding the fins.

7. An apparatus comprising:

a gas turbine engine turbomachinery component having an airfoil shape disposed in proximity to a flow path boundary of the turbomachinery component;

a battery;

a first thermally reversible electrical device, the first thermally reversible electrical device capable of altering the magnitude and direction of heat transfer to a first portion of the flow path boundary in response to a change in current to the first thermally reversible electrical device from the battery;

a controller comprising a processor coupled to the first thermally reversible electrical device, and adapted to regulate the current used to drive the first thermally reversible electrical device; and a second thermally reversible electrical device adapted to convert waste heat into power used to charge the battery;

wherein the heat transfer between the first thermally reversible electrical device and the first portion of the flow path boundary changes the tip clearance between the airfoil shaped component and the flow path boundary.

8. The apparatus of claim 7, wherein the first thermally reversible electrical device is one of a plurality of thermally reversible electrical devices arrayed circumferentially about the gas turbine engine.

9. The apparatus of claim 7, wherein the gas turbine engine turbomachinery component is a part of a compressor and the first thermally reversible electrical device is in thermal communication with the compressor.

10. The apparatus of claim 9, which further includes a turbine, and wherein the second thermally reversible electrical device is disposed in thermal communication with the turbine.

11. The apparatus of claim 10, wherein the second thermally reversible electrical device is one of a plurality of thermally reversible electrical devices in thermal communication with the turbine.

12. The apparatus of claim 7, wherein the first thermally reversible electrical device is a film type device, and the tip clearance control device is structured to change the tip clearance of the airfoil shaped turbomachinery component.

13. The apparatus of claim 7, which further includes fins protruding from the first thermally reversible electrical device into a flow path of the gas turbine engine to facilitate heat transfer for the first thermally reversible electrical device.

14. An apparatus comprising:

a gas turbine engine having a combustor capable of burning a fuel and a turbomachinery component in flow communication with the combustor;

means for thermoelectrically regulating a tip clearance in the turbomachinery component of the gas turbine engine, wherein thermoelectrically regulating the tip clearance includes providing power from a battery to a first thermoelectric device, and operating a second thermoelectric device to convert waste heat to generate power used to charge the battery.

15. A method comprising:

fueling a gas turbine engine to produce a combustion that sustains a thermodynamic cycle of the engine;

passing a working fluid through a first turbomachinery device of the gas turbine engine, the first turbomachinery device having an airfoil shaped component including an end portion offset from a flow path surface of the gas turbine engine;

manipulating a heat transfer of a first thermoelectric device in thermal communication with the first turbomachinery device to regulate the offset between the end portion of the airfoil shaped component and the flow path surface, wherein the first thermoelectric device generates heat in response to a current supplied by a battery; and providing power from a second thermoelectric device to charge the battery, the second thermoelectric device being in thermal communication with a second turbomachinery device of the gas turbine engine.

16. The method of claim 15, wherein the manipulating includes altering a heat transfer of the first thermoelectric device using a controller.

17. The method of claim 15, wherein providing power from the second thermoelectric device includes providing power to a plurality of thermoelectric devices.

18. The method of claim 15, wherein the manipulating includes changing a temperature of the flow path surface to regulate the offset between the end portion of the airfoil shaped component and the flow path surface.

* * * * *